US010996014B2

(12) United States Patent
Schacht et al.

(10) Patent No.: US 10,996,014 B2
(45) Date of Patent: May 4, 2021

(54) MODULAR TRIGGER ASSEMBLY WITH RETRACTABLE LOCKING PINS

(71) Applicant: Rable Machine, Inc., Mansfield, OH (US)

(72) Inventors: Eric Schacht, Pickerington, OH (US); Nicholas Steurer, Miamisburg, OH (US); Nathan Hawkins, Lancaster, OH (US)

(73) Assignee: Rable Machine, Inc., Mansfield, OH (US)

( * ) Notice: Subject to any disclaimer, the term of this patent is extended or adjusted under 35 U.S.C. 154(b) by 0 days.

(21) Appl. No.: 16/936,611

(22) Filed: Jul. 23, 2020

(65) Prior Publication Data

US 2021/0102770 A1 Apr. 8, 2021

Related U.S. Application Data

(63) Continuation of application No. 16/446,716, filed on Jun. 20, 2019, which is a continuation of application No. 16/430,635, filed on Jun. 4, 2019, now Pat. No. 10,731,937.

(60) Provisional application No. 62/680,307, filed on Jun. 4, 2018.

(51) Int. Cl.
*F41A 19/10* (2006.01)

(52) U.S. Cl.
CPC ..... *F41A 19/10* (2013.01)

(58) Field of Classification Search
CPC ..... F41A 19/10; F41A 19/15; F41A 11/02
See application file for complete search history.

(56) References Cited

U.S. PATENT DOCUMENTS

| | | | | |
|---|---|---|---|---|
| 6,722,072 | B1 | 4/2004 | McCormick | |
| 9,863,730 | B2 * | 1/2018 | Elftmann | F41A 19/10 |
| 2016/0187091 | A1 | 6/2016 | Moretti | |
| 2016/0187092 | A1 | 6/2016 | Mather et al. | |
| 2016/0282075 | A1 | 9/2016 | Colman | |
| 2017/0138689 | A1 * | 5/2017 | Biegel | F41A 19/14 |
| 2018/0202740 | A1 | 7/2018 | Elftmann, Jr. | |

* cited by examiner

*Primary Examiner* — J. Woodrow Eldred
(74) *Attorney, Agent, or Firm* — Sand, Sebolt & Wernow Co., LPA

(57) ABSTRACT

A modular trigger assembly having auto-tensioning hammer pin and trigger pins which allow for rapid installation and removal of the modular trigger assembly from the lower receiver of an ArmaLite style modular rifle using minimal tools. When installed and under tension, the auto-tensioning pins remain flush with the exterior of the lower receiver and present no external parts outside of the lower receiver while maintaining anti-walk and anti-roll properties.

15 Claims, 6 Drawing Sheets

MODULAR TRIGGER ASSEMBLY WITH RETRACTABLE LOCKING PINS

CROSS REFERENCE TO RELATED APPLICATIONS

This application is a continuation of U.S. application Ser. No. 16/446,716, filed on Jun. 20, 2019, which is a continuation of U.S. application Ser. No. 16/430,635, filed on Jun. 4, 2019, now U.S. Pat. No. 10,731,937, which claims the benefit of U.S. Provisional Application Ser. No. 62/680,307, filed on Jun. 4, 2018; the disclosures of which are incorporated herein by reference.

TECHNICAL FIELD

The present disclosure relates generally to the field of modular trigger assemblies for modular type firearms. More particularly, the present disclosure relates to a modular trigger assembly for a modular firearm such as an ArmaLite rifle (AR) or other similar modular rifle platforms. Specifically, the present disclosure relates to a modular trigger for modular firearms having retractable locking pins to secure the modular trigger within the lower receiver of a modular rifle while reducing or eliminating pin walk and pin rotation therein.

BACKGROUND

Background Information

Many modern firearms, particularly modern rifle platforms such as the ArmaLite rifle (AR) platforms, are built as modular systems wherein various components may be swapped out or customized according to a user's preference and for the specific use of the rifle. Further, as these modular platforms may support civilian, military, and/or law enforcement usage, it is becoming increasingly common that components are manufactured for use across multiple brands, platforms, and for multiple usage scenarios. One particular component of these rifles that has been adapted in this manner is the trigger mechanism which is increasingly becoming available as modular trigger assemblies.

These modular trigger assemblies are designed to replace the individual trigger components with a single assembly containing all components therein that may be dropped into the lower receiver of an AR style modular rifle. These trigger assemblies are typically held in place within the lower receiver using the existing hammer pin and trigger pin mounting apertures defined in the lower receiver. Modular triggers eliminate the need to install multiple individual components and instead make trigger installation, maintenance, and adjustments occur quickly and with a minimal number of tools. This can be particularly beneficial if maintenance or the like is needed when the rifle is being operated in the field. For example, if the trigger jams due to an obstruction, such as a portion of a shell casing or the like, prior trigger assemblies tend to require complete disassembly of the rifle and trigger assembly to remove the obstruction and then reassembly of the trigger assembly before operation. Modular triggers may allow quick removal of such an obstruction in the field while carrying a minimal number of tools to assist the user in such maintenance tasks.

One common complaint with modular triggers, however, is that the standard hammer and trigger pins used to retain the modular trigger within the lower receiver have a tendency to walk, i.e., slide in and out of engagement with the lower receiver and/or the modular trigger itself during use. Further, these pins tend to rotate while the rifle is being operated as a result of the impact and vibration that occurs with discharging a round from the rifle. As these pins rotate and walk, they may wear on the mounting apertures in the receiver as well as on the bushings and through apertures in the modular triggers such that over time, significant amounts of slop and movement of the trigger may develop which may affect the performance of the rifle. In some cases, the pins may walk to such an extreme as to fall out of the rifle which can cause further damage to the receiver, the modular trigger, and/or may cause the rifle to fail to operate properly. As with any firearm, a poorly functioning or damaged rifle can be dangerous to the operator depending on the particular situation. Thus, having pin walk and/or pin rotation may ultimately create a rifle that is unsafe for use if the damage caused therefrom is extreme or allowed to persist over time.

Many solutions have been attempted to prevent pin walk and/or pin rotation and typically include exterior components that may be further mounted to the outside of the lower receiver. Some known examples include using exterior set screws to hold the pins in place and prevent walk. These setups tend to successfully prevent the pins from walking during use; however, they do not tend to prevent pin rotation. Anti-rotation devices on the other hand tend to involve exterior set screws along with some form of pin retention most commonly achieved by linking the hammer pin and trigger pin together exterior of the lower receiver wall which can be unsightly and can create additional catch points that may be incompatible with certain desirable accessories, such as exterior bolt catches or bolt release levers. Additionally, these kits are typically sold on the aftermarket and increase the cost of installing a modular trigger as they do not tend to be provided with the triggers themselves. While these exterior components tend to address the walk and/or rotation of pins, they are unsightly and many firearm purists find them unattractive and undesirable for that reason alone. Additionally, in maintenance situations, these excess parts increase the number of components that must be accounted for during maintenance and if one were to lose a set screw, an anti-roll bar, or an anti-roll clip during field maintenance, pin walk and pin roll may no longer be prevented and may result further issues with the firearm.

SUMMARY

The present disclosure addresses these and other issues by providing a modular trigger assembly having auto-tensioning hammer pin and trigger pins which allow for rapid installation and removal of the modular trigger assembly from the lower receiver of an AR modular firearm using minimal tools. When installed and under tension, the auto-tensioning pins remain flush with the exterior of the lower receiver and present no external parts outside of the lower receiver while maintaining anti-walk and anti-roll properties.

In one aspect, an exemplary embodiment of the present disclosure may provide a modular trigger assembly comprising: a case containing a trigger unit, a hammer, and a trigger disconnector; a first auto-tensioning pin having a first pair of telescoping pegs adapted to secure a first portion of the trigger assembly within a lower receiver of a rifle; and a second auto-tensioning pin having and a second pair of telescoping pegs adapted to secure a second portion of the trigger assembly within the lower receiver of the rifle.

In another aspect, an exemplary embodiment of the present disclosure may provide a method of preventing pin walk and pin rotation of a modular trigger assembly installed in a rifle comprising: inserting a modular trigger assembly having a case containing a trigger unit, a hammer, and a trigger disconnector therein into a lower receiver of a rifle; unlocking a pair of telescoping pegs contained within a housing of an auto-tensioning pin threadably engaged with the case of the modular trigger assembly; extending the pair of telescoping pegs via a tensioning spring contained within the housing of the auto-tensioning pin between the telescoping pegs; and engaging a pair of apertures defined through the lower receiver of the rifle with the extended pair of telescoping pegs.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
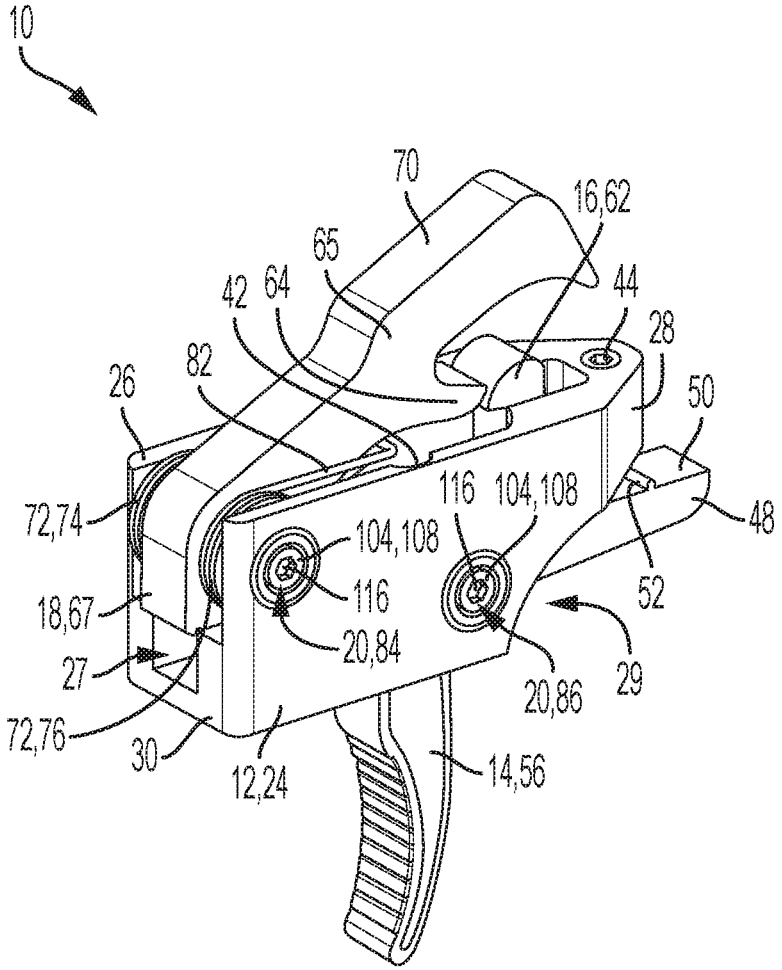
FIG. 1 is a front perspective view of a trigger assembly according to one aspect of the present disclosure.
Figure 2:
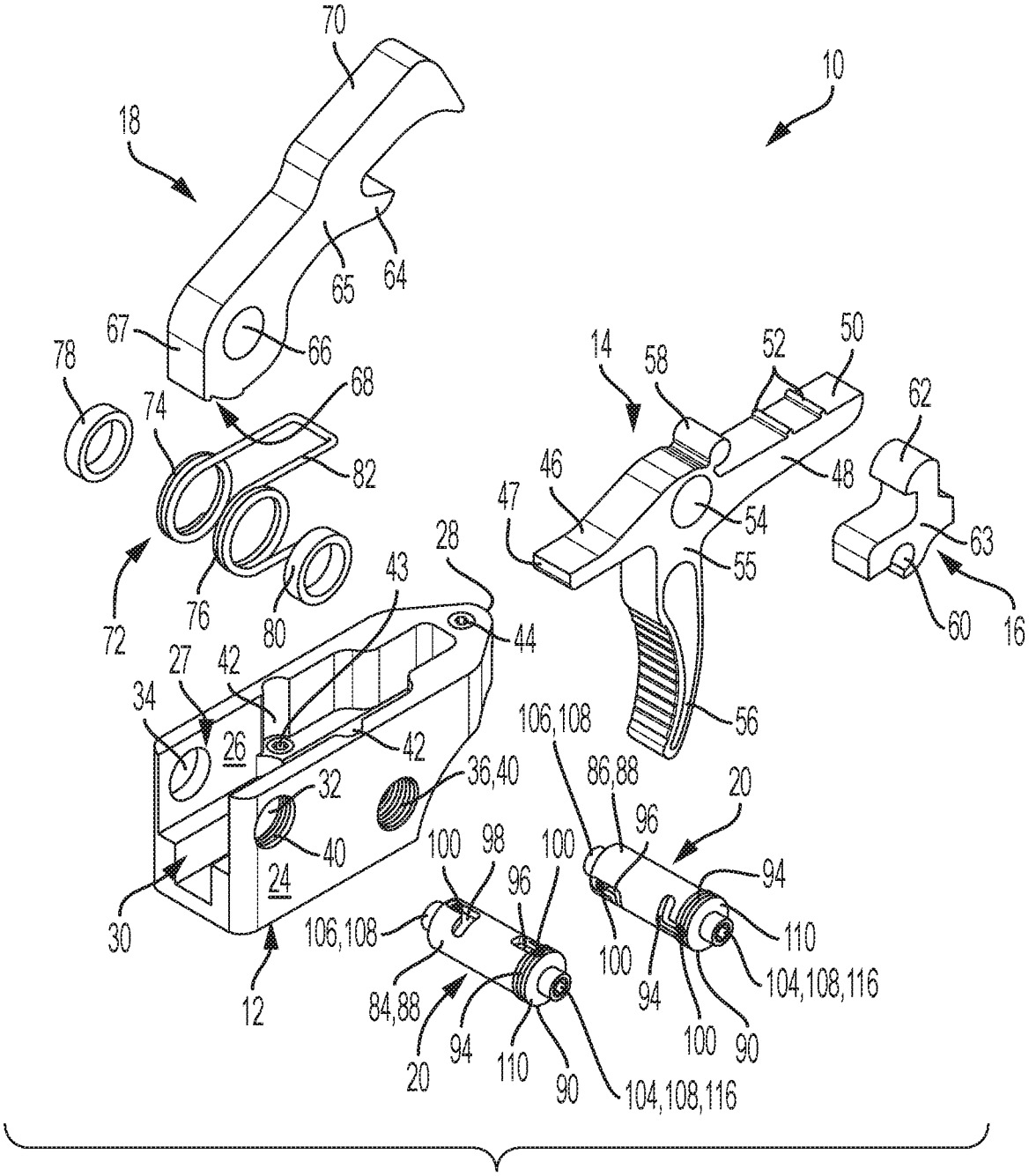
FIG. 2 is an exploded front perspective view of a trigger assembly according to one aspect of the present disclosure.

With reference to FIG. 1, a modular trigger assembly is shown and generally indicated as reference 10. Modular trigger assembly 10 may be hereinafter referred to as modular trigger 10 or trigger assembly 10 and will be understood to refer to the entire modular trigger assembly 10 as depicted in FIG. 1. Modular trigger assembly 10 may include a trigger case 12, a trigger unit 14, a trigger disconnector 16, a hammer 18, and a pair of auto-tensioning pins 20. Trigger assembly 10 may be sized to fit within a lower receiver 22 (best seen in FIGS. 5 and 6) of a standard ArmaLite (AR) style rifle, such as an AR-15 or the like. A depiction of the associated rifle is omitted from the figures for clarity, but it will be understood that any suitable rifle utilizing a modular lower receiver 22 may utilize the trigger assembly 10 of the present disclosure. It will be further understood that trigger assembly 10 may be configured and/or sized for other similar applications, such as for use in other modular rifles that do not use an AR platform. For example, other rifle platforms that may utilize the modular trigger assembly 10 may include the FN-Scar platform, commercially available from Fabrique Nationale (FN) Herstal, and the SIG Sauer MPX platform, commercially available from SIG Sauer GmbH, among others.

Case 12 may be a body or housing of the modular trigger assembly 10 that may function to contain the other components of modular trigger assembly 10 therein. Case 12 may have a first side wall 24 spaced apart from a second side wall 26 and defining a transverse direction therebetween. The space between first side wall 24 and second side wall 26 of case 12 may define the interior 27 of case 12 wherein the other components discussed below may be contained. Case 12 may further have a rear portion 28 spaced apart from a forward end 30 and define a longitudinal direction therebetween. As used herein, with reference to the figures, the first side wall 24 may be oriented to the left side of a rifle and second side wall 26 may be oriented to the right side of the rifle when the trigger assembly 10 is installed and is viewed from behind the rifle as would be the standard view of a marksman while operating the rifle. Similarly, rear portion 28 and forward end 30 may be defined relative to the rifle when trigger assembly 10 is installed within the lower receiver 22 such that the rear portion 28 is towards the rear of the rifle and the forward end 30 points towards the front end of the rifle and away from a marksman as viewed by that marksman while operating the rifle.

First side wall 24 and second side wall 26 may have a series of pin mount holes defined therein to interact and accept auto-tensioning pins 20, as discussed below. Specifically, a first pin mount hole 32 may be defined in the second side wall 26 and aligned and opposite from a second pin mount hole 34 defined in the first side wall 24. Similarly, a third pin mount hole 36 may be defined in the second side wall 26 and aligned with and opposite from a fourth pin mount hole 38 defined in the first side wall 24. Both of the first pin mount hole 32 and the third pin mount hole 36 may include internal threads 94 therein for threadable engagement with the auto-tensioning pins 20.

Each of first side wall 24 and second side wall 26 may include a set screw channel 42 defined therein in which a set screw 43 may be disposed for a vertical height adjustment of trigger assembly 10 within lower receiver 22. These set screws 43 may be used to adjust the vertical height of trigger assembly 10 within lower receiver 22 to align first through fourth pin mount holes 32, 34, 36, 38 with hammer pin mount apertures 122 and trigger pin mount apertures 124 of the lower receiver 22 as discussed further herein.

Rear portion 28 of case 12 may connect first side wall 24 and second side wall 26 while having an opening 29 at the lower end thereof to permit the rearward arm 48 of trigger unit 14 to pass there through. Rear portion 28 may further include a trigger pull adjustment screw 44 which may be used to adjust the pull weight of the trigger as discussed further below.

Forward end 30 of case 12 may be generally open and may be defined by the terminal ends of the first and second side walls 24 and 26. The open forward end 30 may allow hammer 18 to pass there through for engagement with the firing pin of the rifle associated with trigger assembly 10 and lower receiver 22.

Case 12 may be formed of a single piece of material, including hardened steel, stainless steel, anodized aluminum, or similar suitable materials and may be manufactured through any suitable method including machining, die casting, molding, or the like. According to one aspect, case 12 may be precision machined from anodized aluminum.

Trigger unit 14 may have a forward arm 46 generally oriented towards the front of the firearm when trigger assembly 10 is installed in the lower receiver 22 as discussed above. At the forward end of forward arm 46 may be a sear engagement surface 47. Trigger unit 14 may further include a rearward arm 48 extending rearward towards the back of the gun. Rearward arm 48 may have a top surface 50 with one or more trigger unit flanges 52 disposed thereon and extending upwards therefrom. Trigger unit flanges 52 may help ensure that the components of trigger assembly 10 remain aligned and in position when trigger assembly 10 is installed within the lower receiver 22.

Trigger unit 14 may further include a trigger aperture 54 defined there through that may generally define or otherwise represent the central portion 55 of the trigger unit. Trigger aperture 54 may be sized to accept one of the auto-tensioning pins 20 there through. Extending downwards from the central portion 55 and below the trigger aperture 54 of trigger unit 14 may be trigger 56 which may be the user interface between the trigger assembly 10 and the user's finger(s) when trigger assembly 10 is installed within the lower receiver 22. Between forward arm 46 and rearward arm 48 and above trigger aperture 54 may be the disconnector mount 58 for operational connection to the disconnector 16 as discussed below.

Trigger disconnector 16 may include a mounting portion 60 which may be sized and shaped to fit the disconnector mount 58 on trigger unit 14. Mounting portion 60 may have sufficient clearance around disconnector mount 58 to allow disconnector 16 to move about a transverse axis parallel to auto-tensioning pins 20. Disconnector 16 may further include a hammer catch 62 extending upwards from a central portion 63 thereof to interact with a holding arm 64 on hammer 18 as discussed below.

Hammer 18 may include the holding arm 64 extending rearward from a central portion thereof. Hammer 18 may include a hammer aperture 66 defined through a forward end 67 thereof for operational connection to trigger assembly 10. Hammer aperture 66 may be sized to accept an auto-tensioning pin 20 there through as discussed below. Hammer 18 may also include a cocking notch 68 at the forward end 67 for operational interaction with sear engagement surface 47 of trigger unit 14. Hammer 18 may have an impact surface 70 which, in operation (discussed below) may impact the firing pin of the firearm in which trigger assembly 10 is installed.

Hammer 18 may also include a hammer spring 72 with a first spring coil 74 and a second spring coil 76. First and second spring coils 74, 76 may wrap around first and second mandrels 78, 80, respectively, when installed in the trigger assembly 10. Hammer spring 72 may further include a spring arm 82 which may extend rearward therefrom and may interact with the trigger unit 14 and/or disconnector 16. Hammer spring 72 may be operational to keep tension on the trigger unit 14 and the hammer 18 which may further allow hammer 18 to be driven forward to fire a round from the firearm, as discussed below.

First and second spring mandrels 78 and 80 may be cylindrical rings which may be contained within the interior of first and second spring coils 74 and 76, respectively. First and second mandrels 78, 80 may be aligned with hammer aperture 66 to allow auto-tensioning pin 20 to pass there through. Mandrels 78 and 80 may be formed of any suitable material, including steel, hardened steel, thermoplastics, polymers, or the like.

Trigger unit 14, trigger disconnector 16, and hammer 18 may be formed from any suitable material, including hardened steel, stainless steel, anodized aluminum, or any other suitable material and may be manufactured with any suitable method including machining, casting, or the like. According to one aspect, trigger unit 14, trigger disconnector 16, and hammer 18, may be precision machined from hardened steel.

Trigger assembly 10 may include two auto-tensioning pins 20 which may be a hammer pin 84 and a trigger pin 86. As alluded to above, these auto-tensioning pins 20 are named as the hammer pin 84 and the trigger pin 86 based upon the apertures through which they pass, i.e., hammer pin 84 may pass through hammer aperture 66 in hammer 18 and through first and second pin mount holes 32, 34 defined through case 12 and aligned therewith. Similarly, trigger pin 86 may pass through trigger aperture 54 defined through trigger unit 14 and third and fourth pin mount holes 36, 38 defined through case 12 and aligned therewith. But for their placement in the trigger assembly 10, hammer pin 84 and trigger pin 86 may be substantially identical and may interchangeable without prejudice. Therefore, the naming convention utilized herein refers to them merely for their location in trigger assembly 10 and general references to auto-tensioning pins 20 and the structure/operation thereof will be equally applicable to either hammer pin 84 or trigger pin 86, unless specifically indicated otherwise.

Figure 3:
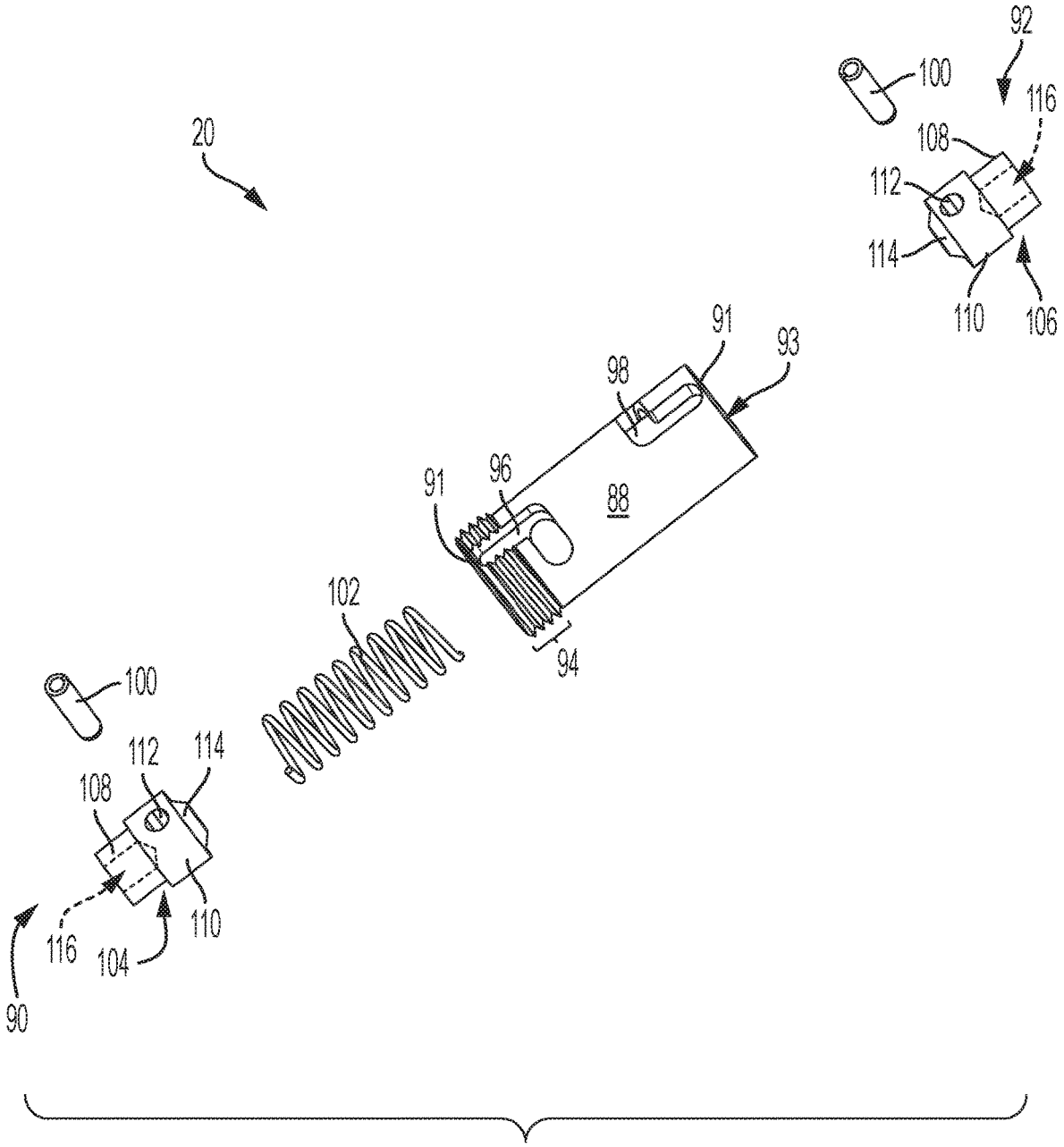
FIG. 3 is an exploded view of an auto-tensioning pin according to one aspect of the present disclosure.

With reference now to FIG. 3, an exploded view of an auto-tensioning pin 20 is shown. Auto-tensioning pin 20 may include a pin housing 88 having a first end 90 spaced apart from a second end 92 and defining the longitudinal length of the auto-tensioning pins 20 therebetween. Pin housing 88 may be substantially cylindrical in shape and may have a hollow interior 93 defined there through. First and second ends 90, 92 may be open such that the hollow interior 93 may be a through aperture defined through pin housing 88. Pin housing 88 may further include a first retaining pin slot 96 which may be generally L-shaped and may extend through pin housing 88. First pin slot 96 may span from adjacent first end 90 towards second end 92 before making a 90° turn towards one side of pin housing 88. First pin slot 96 may terminate near the first end 90 of housing 88 without extending there through such that a small portion of pin housing 88 may form a terminal flange 91 that may keep a retaining pin 100 from passing out of first pin slot 96 at first end 90.

Pin housing 88 may also include a second retaining pin slot 98 extending through pin housing 88 and spanning from adjacent second end 92 towards first end 90 before making a 90° turn in the opposite direction from first retaining pin slot 96. As with first pin slot 96, second pin slot 98 does not extend fully through second end 92 such that a terminal flange 91 may be present at second end 92 as well to keep a retaining pin 100 from passing out of second retaining pin slot 98 at second end 92. Accordingly, auto-tensioning pin 20 may have two retaining pins 100 that may pass through retaining pin slots 96, 98 and into a retaining pin mount 112 defined within a first telescoping peg 104 and second telescoping peg 106, as discussed more thoroughly below.

Auto-tensioning pins 20 may have a tensioning spring 102 which may be formed of hardened spring steel and may be housed within the hollow interior 93 of pin housing 88 and may interact with first and second telescoping pegs 104, 106 as further discussed below.

First end 90 of pin housing 88 may include external threads 94 to engage internal threads 94 in first and third pin mount holes 32, 36 to connect auto-tensioning pins 20 to case 12 to help prevent rotation or walking thereof, as discussed further herein.

First and second telescoping pegs 104, 106 may be substantially identical with first telescoping peg 104 placed at first end 90 of pin housing 88 and second telescoping peg 106 placed at second end 92 of pin housing 88. Telescoping pegs 104, 106 may include a mounting head 108 which may be the portion of auto-tensioning pin 20 that may interact with the hammer pin mount aperture 122 and/or trigger pin mount aperture 124 in the lower receiver 22, as discussed below. The mounting head 108 of telescoping pegs 104, 106 may be sized to fit most standard apertures 122, 124 defined in the lower receiver 22, which, according to one aspect, may be 0.154 inches in diameter. Telescoping pegs 104, 106 may include a collar 110 sized to fit within the hollow interior 93 of pin housing 88. Collar 110 may include a retaining pin mount 112 defined there through for operational engagement with retaining pins 100. Telescoping pegs 104, 106 may include a tapered head 114 which may sit inside the coils of tensioning spring 102 to form a tight fit therewith and prevent tensioning spring 102 from moving laterally within pin housing 88.

The mounting head 108 of telescoping pegs 104, 106 may have an internal hex cavity 116 defined therein. According to one aspect, internal hex cavity 116 may extend partly into collar 110. Internal hex cavity 116 may allow for use of a hex or "Allen" wrench to rotate telescoping pegs 104, 106 relative to the housing 88 to extend and/or compress the tensioning spring 102 to unlock or lock the telescoping pegs 104, 106 within pin housing 88, as discussed below.

Although described herein as an internal hex cavity 116 compatible with hex or "Allen" style wrenches, it will be understood that cavity 116 within heads 108 of telescoping pegs 104 and 106 may be any style of screw set including, but not limited to, hex, star (commonly referred to by the brand name "Torx"), Phillips, Robertson square, or any other suitable screw set style.

Lower receiver 22 may be a standard specification lower receiver 22 for an AR style modular rifle. Lower receiver 22 may be commercially available from multiple manufacturers and may have standardized dimensions that are universal or nearly universal amongst these manufacturers. Lower receiver 22 may have a first receiver wall 118 with a hammer pin mount aperture 122 and a trigger pin mount aperture 124 defined there through. As with case 12, the first receiver wall 118 would be the wall to the left of the firearm and second receiver wall 120 would be the wall to the right side of the firearm when viewed from proper firing position behind the rifle. Opposite first receiver wall 118, and spaced transversely apart therefrom, may be second receiver wall 120 which may also include a hammer pin mount aperture 122 and a trigger pin mount aperture 124 defined there through and aligned with hammer pin and trigger pin mount apertures 122 and 124 defined through first receiver wall 118. Hammer pin mount apertures 122 and trigger pin mount apertures 124 may be positioned in lower receiver 22 such that when trigger assembly 10 is inserted therein, the hammer pin mount apertures 122 in first and second receiver walls 118 and 120 may align with the first and second pin mount holes 32, 34 of case 12, and with hammer aperture 66 of hammer 18. Similarly, trigger pin mount apertures 124 in first and second receiver walls 118 and 120 may align with the third and fourth pin mount holes 36, 38 of case 12 and with trigger aperture 54 of trigger unit 14.

Having thus described the elements and components of trigger assembly 10, the installation, operation, and use thereof will now be discussed.

Trigger assembly 10 and the components thereof may be connected and installed within case 12 according to known configurations. Additionally, the operation of trigger assembly 10 overall in its use in firing a projectile from an associated rifle may also occur according to known principles.

Specifically, trigger unit 14 may be operationally connected to disconnector 16 via disconnector mount 58 and mounting portion 60. Hammer 18, including hammer spring 72, may also be connected to trigger unit 14 with spring arm 82 in contact with top surface 50 of rearward arm 48 of trigger unit 14. First and second spring coils 74 and 76 may be placed over first and second spring mandrels 78 and 80 and aligned with hammer aperture 66. Once assembled, these components may be placed within case 12 with hammer aperture 66 aligned with first and second pin mount holes 32, 34 and trigger aperture 54 aligned with third and fourth pin mount holes 36, 38, respectively.

Figure 5:
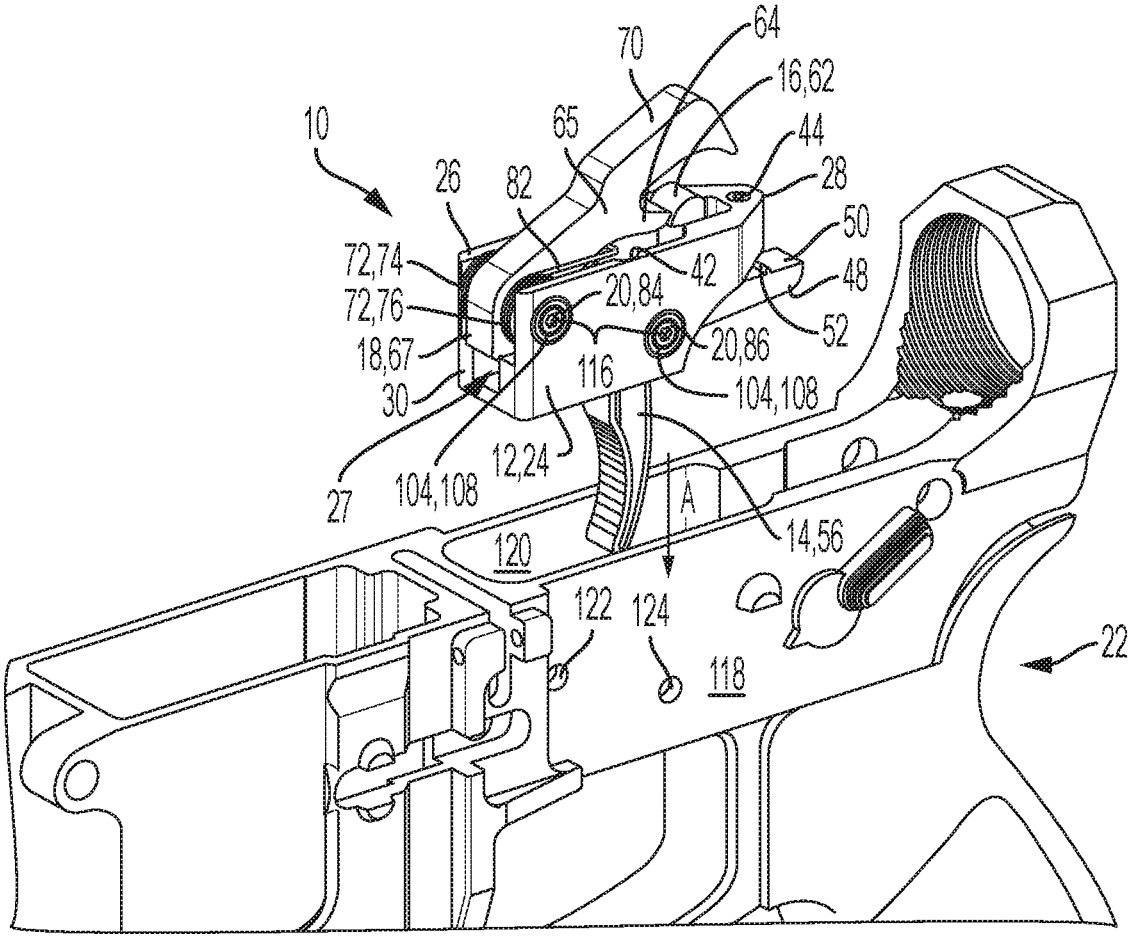
FIG. 5 is a front perspective operational view of a trigger assembly being installed into a lower receiver of an associated rifle according to one aspect of the present disclosure.

With these components connected and inserted within case 12, one of the auto-tensioning pins 20 may be inserted through first pin mount hole 32 and hammer aperture 66 towards second pin mount hole 34 while the other auto-tensioning pin 20 may be inserted through third pin mount hole 36 and trigger aperture 54 towards fourth pin mount hole 38. As external threads 94 on pin housing 88 encounter internal threads 94, auto-tensioning pins 20 may be rotated to threadably engage external threads 94 with internal threads 94 to secure auto-tensioning pins 20 within the mount holes 32, 34, 36, and/or 38 and the hammer aperture 66 and trigger aperture 54. In this configuration (as best seen in FIGS. 1 and 5), trigger assembly 10 is fully assembled and ready to be installed within a lower receiver 22 of an AR style rifle according to the following steps.

Figure 4A:
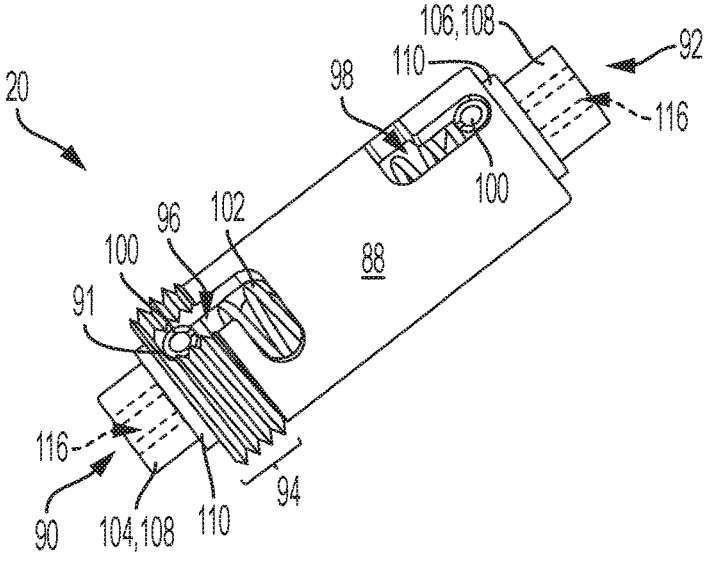
FIG. 4A is a perspective view of an auto-tensioning pin in an extended configuration according to one aspect of the present disclosure.
Figure 4B:
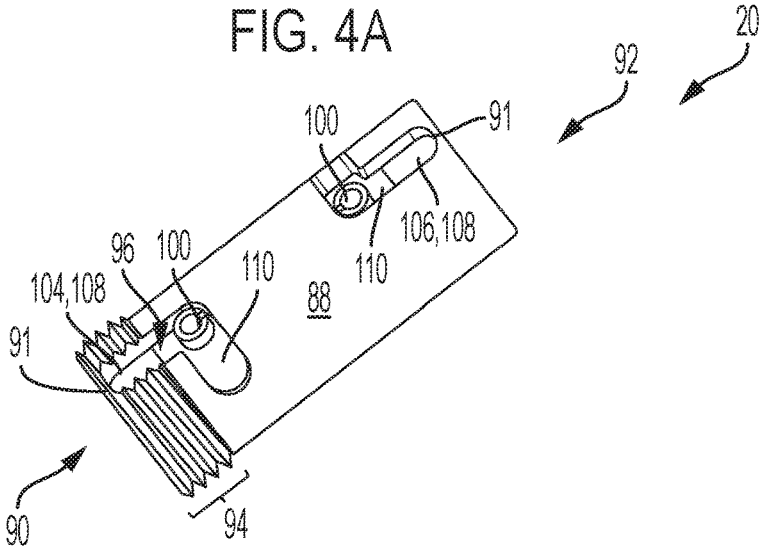
FIG. 4B is a perspective view of an auto-tensioning pin in a compressed configuration according to one aspect of the present disclosure.
Figure 4C:
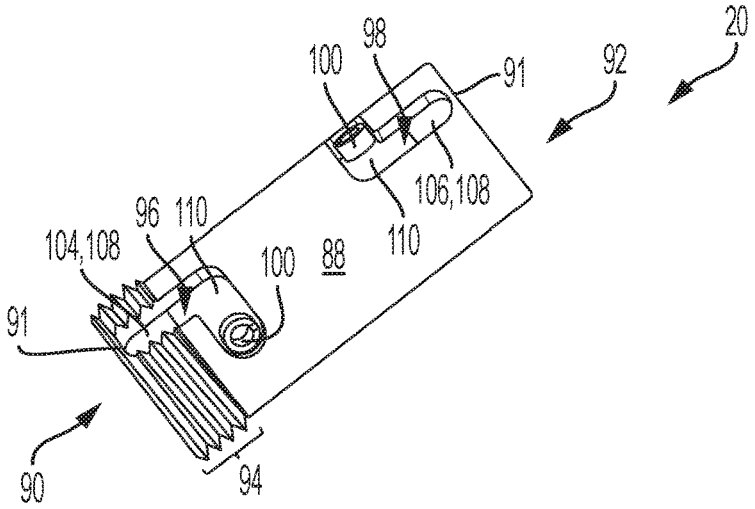
FIG. 4C is a perspective view of an auto-tensioning pin in a locked configuration according to one aspect of the present disclosure.

With reference to FIGS. 4A-4C, the auto-tensioning pins 20 are shown in various configurations, namely, with telescoping pegs 104, 106 extended in FIG. 4A; with telescoping pegs 104, 106 retracted into but not locked within housing 88 and with spring 102 compressed in FIG. 4B; and with telescoping pegs 104, 106 both retracted and locked, and with spring 102 compressed in FIG. 4C. In order to install trigger assembly 10 within lower receiver 22, telescoping pegs 104, 106 need to be in the locked position, as depicted in FIG. 4C. If telescoping pegs 104, 106 are in the locked position, the installation of trigger assembly 10 in the lower receiver 22 may proceed as discussed below; however, if telescoping pegs 104, 106 are extended as depicted in FIG. 4A, they must first be compressed and locked as depicted in FIGS. 4B and 4C before trigger assembly 10 may be inserted into the lower receiver 22.

Accordingly, to move the telescoping pegs 104, 106 from their extended position to their locked position, a user must first insert an Allen wrench into each of the internal hex cavities 116 defined within the mounting heads 108 the first and second telescoping pegs 104, 106. It is contemplated that the user will utilize two similarly sized Allen wrenches simultaneously on each of the first and second telescoping pegs 104 and 106, however, it will be understood that these steps may be accomplished with a single Allen wrench operating each of first and second telescoping pegs 104 and 106 separately and in succession. Once Allen wrenches have been inserted into the internal hex cavities 116, the user may apply pressure to compress the tensioning spring 102 within pin housing 88 before rotating telescoping pegs 104, 106 in opposite directions to lock the telescoping pegs 104, 106 in place inside the housing 88.

With reference to the positions of the retaining pins 100 in each position, in the extended position shown in FIG. 4A, retaining pins 100 are adjacent to the flange 91 at first and second ends 90, 92 of pin housing 88. In the compressed position shown in FIG. 4B, the spring 102 is compressed and retaining pins 100 are adjacent the apex of the L-shaped retaining pin slots 96, 98. In the locked position shown in FIG. 4C, the retaining pins 100 have fully traversed the length of the L-shaped retaining pin slots 96, 98 and are adjacent the end of the slots 96, 98 opposite the flanges 91 at first and second ends 90, 92 of housing 88.

Now having installed all components of trigger assembly 10 within the case 12 and locked the first and second telescoping pegs 104, 106 within pin housing 88 of auto-tensioning pins 20, a user may then drop the trigger assembly 10 into the lower receiver 22 as indicated by Arrow A in FIG. 5. Upon placing trigger assembly 10 within lower receiver 22 the auto-tensioning pins 20 may not initially be properly aligned with the hammer pin and trigger pin mount apertures 122, 124 in either the vertical or longitudinal directions (transverse adjustments will be corrected through action of the auto-tensioning pins 20, as discussed below). For longitudinal adjustments, the user may merely slide the case 12 forward or rearward within lower receiver 22 to longitudinally align the telescoping pegs 104, 106 with the hammer pin and trigger pin mount apertures 122, 124.

Vertical adjustments, however, may be made utilizing set screws 43 within set screw channels 42 of case 12. According to one aspect, set screws 43 may be hex head screws with the same size internal hex cavity as internal hex cavity 116 of telescoping pegs 104, 106 such that a user may utilize the same Allen wrenches to operate both telescoping pegs 104, 106 and set screws 43 within set screw channels 42 of case 12. Set screws 43 may be advanced through set screw channels 42 to raise trigger assembly 10 within lower receiver 22 or may alternatively retracted within set screw channels 42 to lower the height of trigger assembly 10 in lower receiver 22. Similarly, as there is a set screw channel 42 defined in each of first and second side walls 24, 26 of case 12, set screws 43 within set screw channels 42 may be used to adjust the yaw, or transverse level, of trigger assembly 10. For example, if trigger assembly 10 is aligned with the hammer pin and trigger pin mount apertures 122, 124 on the first receiver wall 118 of lower receiver 22 but not the second receiver wall 120, the set screws 43 within set screw channels 42 may be adjusted individually to level the trigger assembly 10 and vertically align the telescoping pegs 104, 106 with the hammer pin and trigger pin mount apertures 124, 122.

Figure 6:
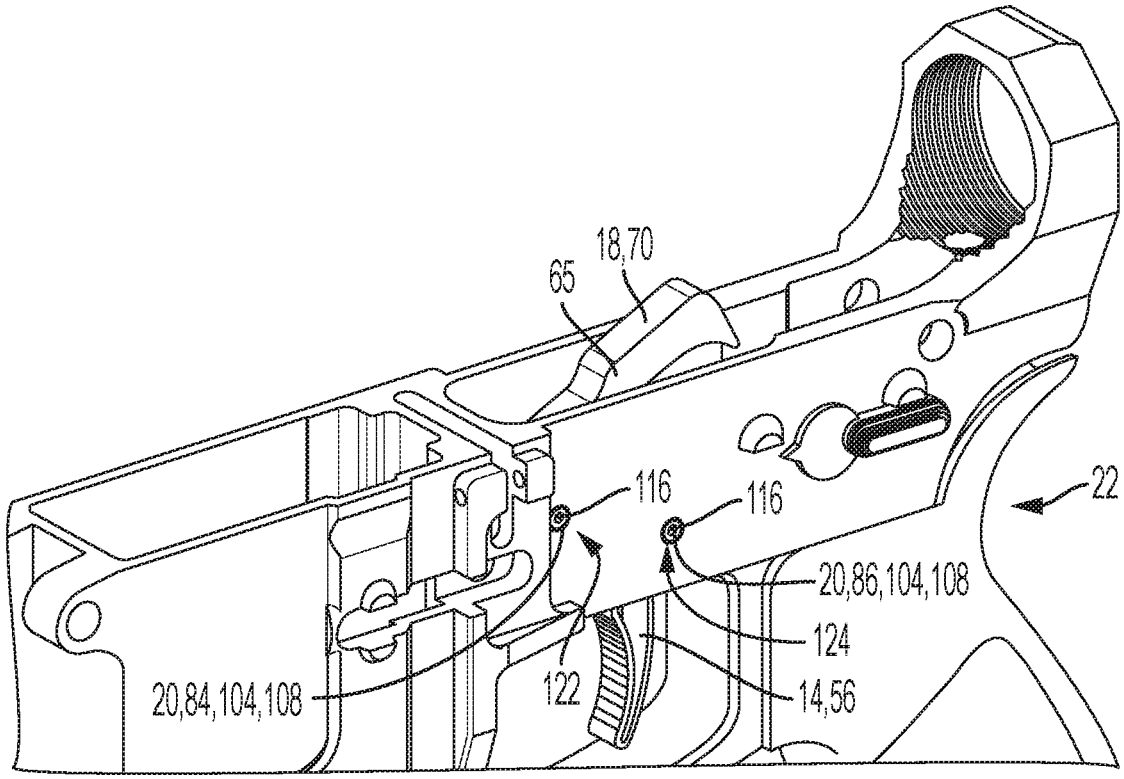
FIG. 6 is a front perspective operational view of a trigger assembly having been installed into a lower receiver of an associated rifle according to one aspect of the present disclosure.

Once properly positioned within lower receiver 22 with telescoping pegs 104, 106 properly aligned both vertically and longitudinally with hammer pin and trigger pin mount apertures 122, 124, the user may insert the Allen wrenches through the hammer pin and trigger mount apertures 122, 124 and into the internal hex cavities 116 defined in mounting head 108 of telescoping pegs 104, 106. It is again contemplated that the user will utilize two similarly sized Allen wrenches simultaneously; however, the following steps can again be accomplished with a single Allen wrench. Once the Allen wrenches are inserted into the internal hex cavity 116 of mounting head 108 of first and second telescoping pegs 104, 106 of either the hammer pin 84 or the trigger pin 88, the user may rotate the Allen wrenches to unlock the telescoping pegs 104, 106 from the housing 88. To do so, the user will rotate the Allen wrenches in the direction opposite the direction they were rotated to lock the telescoping pegs 104 and 106. This will move the retaining pins 100 along the L-shaped retaining pin slots 96, 98 until they are again adjacent the apex of the slots 96, 98. At this point, the user may simply release the pressure on the Allen wrenches and tensioning spring 102 will drive the telescoping pegs 104 and 106 outwards to extend them into the pin mount apertures 122, 124 of lower receiver 22 corresponding to the particular auto-tensioning pin 20 (e.g. hammer pin 84 or trigger pin 86) being unlocked. This process may then be repeated to unlock the other of the hammer pin 84 or trigger pin 86 to further extend the mounting heads 108 of telescoping pegs 104, 106 of that particular pin 84, 86 to likewise engage the corresponding pin mount apertures 122, 124 of lower receiver 22. Once both hammer pin 84 and trigger pin 86 have been extended, the mounting heads 108 of telescoping pegs 104, 106 thereof may be secured within the hammer pin and trigger pin mount apertures 122, 124 to be substantially flush with the outer surface of first and second receiver walls 118, 120 of lower receiver 22, as shown in FIG. 6. The tensioning spring 102 may further provide tension on the mounting heads 108 of telescoping pegs 104, 106 within the mount apertures 122, 124 to securely hold trigger assembly 10 in place without any walking or rotation of auto-tensioning pins 20 thereby preventing many of the problems associated with walking or rotating pins utilized with modular trigger assemblies such as modular trigger assembly 10.

Further, as auto-tensioning pins 20 utilize a single tensioning spring 102 to extend and hold telescoping pegs 104, 106 in place, the trigger assembly 10 will remain evenly situated between the receiver walls 118 and 120 without the need for additional transverse adjustments.

Finally, with trigger assembly 10 fully installed, the trigger pull thereof may be adjusted by advancing or retreating the trigger pull adjustment screw 44 in case 12. The trigger pull adjustment screw 44 may interact with top surface 50 of rearward arm 48 of trigger unit 14 to adjust the pressure on hammer spring 72 which in turn may adjust the amount of force needed to pull the trigger 56 enough to release the hammer 18 to fire a round from the rifle.

Removal of trigger assembly 10 from lower receiver 22 for maintenance and/or replacement is as simple as reversing the above process to compress telescoping pegs 104, 106 and locking them in place within pin housing 88 as discussed above before lifting the trigger assembly 10 up and out of the lower receiver 22 in the direction opposite Arrow A in FIG. 5.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed:

1. A modular trigger assembly comprising:

a case containing a trigger unit, a hammer, and a trigger disconnector;

an auto-tensioning pin having a first pair of telescoping pegs adapted to secure the trigger assembly within a lower receiver of a rifle;

a tensioning spring operably connected to the auto-tensioning pin and the first pair of telescoping pegs; and a pin housing of the auto-tensioning pin having a hollow interior adapted to contain the tensioning spring and the first pair of telescoping pegs therein, wherein the pin housing has external threads disposed on a first end thereof.

2. The modular trigger assembly of claim 1 wherein the case further comprises:

a first mount hole defined through a first side wall of the case; and a second mount hole defined through a second side wall of the case and aligned with the first mount hole defined through the first side wall.

3. The modular trigger assembly of claim 2 wherein the first mount hole defined through the first side wall further comprises:

internal threads operable to engage the external threads on the auto-tensioning pin.

4. The modular trigger assembly of claim 1 wherein each of the auto-tensioning pin further comprises:

a first retaining pin disposed through a first retaining pin slot defined through the pin housing adjacent a first end of the auto tensioning pin; and a second retaining pin disposed through a second retaining pin slot defined through the pin housing adjacent a second end of the auto tensioning pin.

5. The modular trigger assembly of claim 4 wherein each peg of the telescoping pegs further comprises:

a mounting head sized to fit within an aperture defined through a wall of the lower receiver of the rifle; and a collar having a retaining pin mount defined therein adapted to engage one of the first and second retaining pins.

6. The modular trigger assembly of claim 5 wherein each mounting head of the telescoping pegs further comprises:

an internal hex cavity defined therein.

7. A method of preventing pin walk and pin rotation of a modular trigger assembly installed in a rifle comprising:

inserting a modular trigger assembly having a case containing a trigger unit, a hammer, and a trigger disconnector therein into a lower receiver of a rifle;

unlocking a pair of telescoping pegs contained within a housing of an auto-tensioning pin threadably engaged with the case of the modular trigger assembly by rotating the pair of telescoping pegs to move a pair of retaining pins disposed through a first and second retaining pin slot defined through the housing of the auto-tensioning pin;

extending the pair of telescoping pegs via a tensioning spring contained within the housing of the auto-tensioning pin between the telescoping pegs; and engaging a pair of apertures defined through the lower receiver of the rifle with the extended pair of telescoping pegs.

8. The method of claim 7 further comprising:

preventing the auto-tensioning pin from rotating relative to the case via the threaded engagement of the pin housing and the case; and preventing the auto-tensioning pin from walking out of engagement with the apertures in the lower receiver via tension on the telescoping pegs from the tensioning spring.

9. The method of claim 7 wherein rotating the first and second pairs of telescoping pegs further comprises:

inserting a pair of Allen wrenches into internal hex cavities defined within each peg of the pair of telescoping pegs; and rotating the pair of telescoping pegs in opposite directions with the pair of Allen wrenches.

10. The method of claim 7 further comprising:

extending the pair of telescoping pegs via a tensioning spring contained within the housing of the auto-tensioning pin between the pair of telescoping pegs.

11. The method of claim 10 wherein extending the pair of telescoping pegs is accomplished by releasing pressure on the tensioning spring contained within the housing of the auto-tensioning pin.

12. The method of claim 11 further comprising:

preventing the modular trigger assembly from transverse movement via pressure applied to the pair of telescoping pegs by the tensioning spring when the pair of telescoping pegs are extended and engaged with the lower receiver of the rifle.

13. The method of claim 7 further comprising:

compressing the tensioning spring within the housing of the auto-tensioning pin to retract the pair of telescoping pegs into the housing; and locking the pair of telescoping pegs into the housing prior to inserting the modular trigger assembly into the lower receiver of the rifle.

14. The method of claim 13 wherein compressing the tensioning spring within the housing of the auto-tensioning pin further comprises:

inserting a pair of Allen wrenches into internal hex cavities defined within each peg of the pair of telescoping pegs; and applying force to each peg of the pair of telescoping pegs via the Allen wrenches to squeeze the spring.

15. The method of claim 14 wherein locking the pair of telescoping pegs into the housing further comprises:

rotating the pair of telescoping pegs in opposite directions to move a pair of retaining pins disposed through a first and second retaining pin slot defined through the housing of the auto-tensioning pin and into a locked position.

* * * * *